US008843025B2

(12) United States Patent
Sato

(10) Patent No.: US 8,843,025 B2
(45) Date of Patent: Sep. 23, 2014

(54) TONER CARTRIDGE HAVING AN OPENABLE AND CLOSEABLE OPENING AND PROCESS CARTRIDGE HAVING AN OPENABLE AND CLOSEABLE OPENING

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 355 days.

(21) Appl. No.: 13/241,309

(22) Filed: Sep. 23, 2011

(65) Prior Publication Data

US 2012/0076534 A1 Mar. 29, 2012

(30) Foreign Application Priority Data

Sep. 29, 2010 (JP) ..... 2010-218344

(51) Int. Cl.
*G03G 21/16* (2006.01)
*G03G 15/08* (2006.01)
*G03G 21/18* (2006.01)

(52) U.S. Cl.
CPC ..... *G03G 15/0877* (2013.01); *G03G 21/1821* (2013.01); *G03G 15/0886* (2013.01)
USPC ..... 399/111; 399/119; 399/262

(58) Field of Classification Search
CPC ..... G03G 21/1821; G03G 15/0877; G03G 15/0886
USPC ..... 399/119, 111, 113, 262
See application file for complete search history.

(56) References Cited

U.S. PATENT DOCUMENTS

| | | | | |
|---|---|---|---|---|
| 7,574,161 | B2 | 8/2009 | Ota | |
| 7,949,287 | B2 | 5/2011 | Ota | |
| 2006/0204249 | A1* | 9/2006 | Sugiyama | 399/262 |
| 2007/0077099 | A1 | 4/2007 | Ota | |
| 2007/0223963 | A1 | 9/2007 | Suzuki et al. | |

(Continued)

FOREIGN PATENT DOCUMENTS

| | | | |
|---|---|---|---|
| CN | 101639650 | A | 2/2010 |
| EP | 1768002 | A1 | 3/2007 |

(Continued)

OTHER PUBLICATIONS

Notification of the First Office Action with Search Report issued in corresponding Chinese Patent Application No. 201110284513.6 mailed Feb. 18, 2013.

(Continued)

*Primary Examiner* — Susan Lee
(74) *Attorney, Agent, or Firm* — Banner & Witcoff, Ltd.

(57) ABSTRACT

A process cartridge includes a first cartridge and a second cartridge. The first cartridge includes a frame, a first opening and closing member and a first operating member. The first opening and closing member is configured to open and close a first opening formed in the first wall. The second cartridge includes a housing, a second opening and closing member, a second operating member and a third operating member. The second opening and closing member is movable between an open position in which a second opening formed in the second wall is opened and a closed position in which the second opening is closed. The third operating member faces the second operating member spaced therebetween. When the second cartridge is attached to the first cartridge, the second operating member and the third operating member are integrally displaced via the first operating member.

18 Claims, 12 Drawing Sheets

(56) References Cited

U.S. PATENT DOCUMENTS

| | | | | |
|---|---|---|---|---|
| 2007/0223964 | A1 | 9/2007 | Takagi | |
| 2007/0223965 | A1* | 9/2007 | Takagi | 399/113 |
| 2007/0223971 | A1 | 9/2007 | Takagi | |
| 2007/0237551 | A1* | 10/2007 | Kawai | |
| 2008/0025758 | A1* | 1/2008 | Sato | 399/119 |
| 2008/0226341 | A1* | 9/2008 | Mase et al. | 399/119 |
| 2008/0240774 | A1* | 10/2008 | Fukamachi et al. | 399/111 |
| 2008/0298837 | A1* | 12/2008 | Mase | 399/119 |
| 2009/0263165 | A1 | 10/2009 | Ota | |
| 2010/0272474 | A1* | 10/2010 | Sato | 399/262 |
| 2011/0020032 | A1* | 1/2011 | Ishii et al. | 399/119 |
| 2011/0280612 | A1* | 11/2011 | Itabashi | 399/262 |
| 2012/0275821 | A1* | 11/2012 | Watanabe | 399/111 |

FOREIGN PATENT DOCUMENTS

| | | | |
|---|---|---|---|
| JP | 09-274352 | A | 10/1997 |
| JP | 2005-037673 | A | 2/2005 |
| JP | 2005-250002 | A | 9/2005 |
| JP | 2008-026830 | | 2/2008 |
| JP | 2008-046250 | A | 2/2008 |
| JP | 2008-083517 | | 4/2008 |

OTHER PUBLICATIONS

Notice of Reasons for Rejection issued in corresponding Japanese Patent Application No. 2010-218344 dated Jun. 4, 2013.

Notice of Reasons for Rejection issued in corresponding Japanese Patent Application No. 2010-218344 dated Aug. 14, 2012.

* cited by examiner

TONER CARTRIDGE HAVING AN OPENABLE AND CLOSEABLE OPENING AND PROCESS CARTRIDGE HAVING AN OPENABLE AND CLOSEABLE OPENING

CROSS REFERENCE TO RELATED APPLICATION

The present application claims priority from Japanese Patent Application No. 2010-218344, which was filed on Sep. 29, 2010, the disclosure of which is incorporated herein by reference in its entirety.

BACKGROUND

1. Field of the Invention

The present invention relates to a toner cartridge and a process cartridge which are installed in an image forming apparatus, such as a laser printer.

2. Description of the Related Art

An image forming apparatus in which a process cartridge is detachably installed and a toner cartridge is attached to the process cartridge is known.

In such an image forming apparatus, since an operating portion for opening an opening formed in the toner cartridge is exposed, the operating portion may be moved due to contact with other members and the opening of the toner box may be opened, whereby the toner contained in toner cartridge may come out.

SUMMARY

A need has arisen to provide a toner cartridge and a process cartridge capable of reducing undesirable opening of the opening formed in the toner cartridge.

According to an embodiment of the present invention, a toner cartridge includes a housing, an opening and closing member, a first operating member and a second operating member. The housing has a wall extending in a predetermined direction and is configured to contain toner. The opening and closing member is movable between an open position in which an opening formed in the wall is opened and a closed position in which the opening is closed. The first operating member is movable in conjunction with the opening and closing member and is configured to move the opening and closing member between the open position and the closed position. The second operating member is configured to be movable and face the first operating member spaced therebetween such that moving of the second operating member is not directly transmitted to the first operating member.

According to another embodiment of the present invention, a process cartridge includes a first cartridge and a second cartridge configured to be attached to the first cartridge along an attachment direction. The first cartridge includes a frame, a first opening and closing member and a first operating member. The frame has a first wall disposed along a width direction perpendicular to the attachment direction and is configured to support a toner carrier which carries toner. The first opening and closing member is movable with respect to the first wall and is configured to open and close a first opening formed in the first wall. The first operating member is movable in conjunction with the first opening and closing member and is configured to be operated to open and close the first opening. The second cartridge includes a housing, a second opening and closing member, a second operating member and a third operating member. The housing has a second wall adjacent to the first wall when the second cartridge is attached to the first cartridge and configured to contain toner. The second opening and closing member is movable between an open position in which a second opening formed in the second wall is opened and a closed position in which the second opening is closed. The second operating member is movable in conjunction with the second opening and closing member and is configured to move the second opening and closing member between the open position and the closed position. The third operating member is displaceable with respect to the housing and faces the second operating member spaced therebetween. When the second cartridge is attached to the first cartridge, the second operating member and the third operating member are integrally displaced via the first operating member.

DESCRIPTION OF THE PREFERRED EMBODIMENTS

Hereinafter, an embodiment of the present invention will be described in detail with reference to the accompanying drawings.

1. Laser Printer

Figure 1:
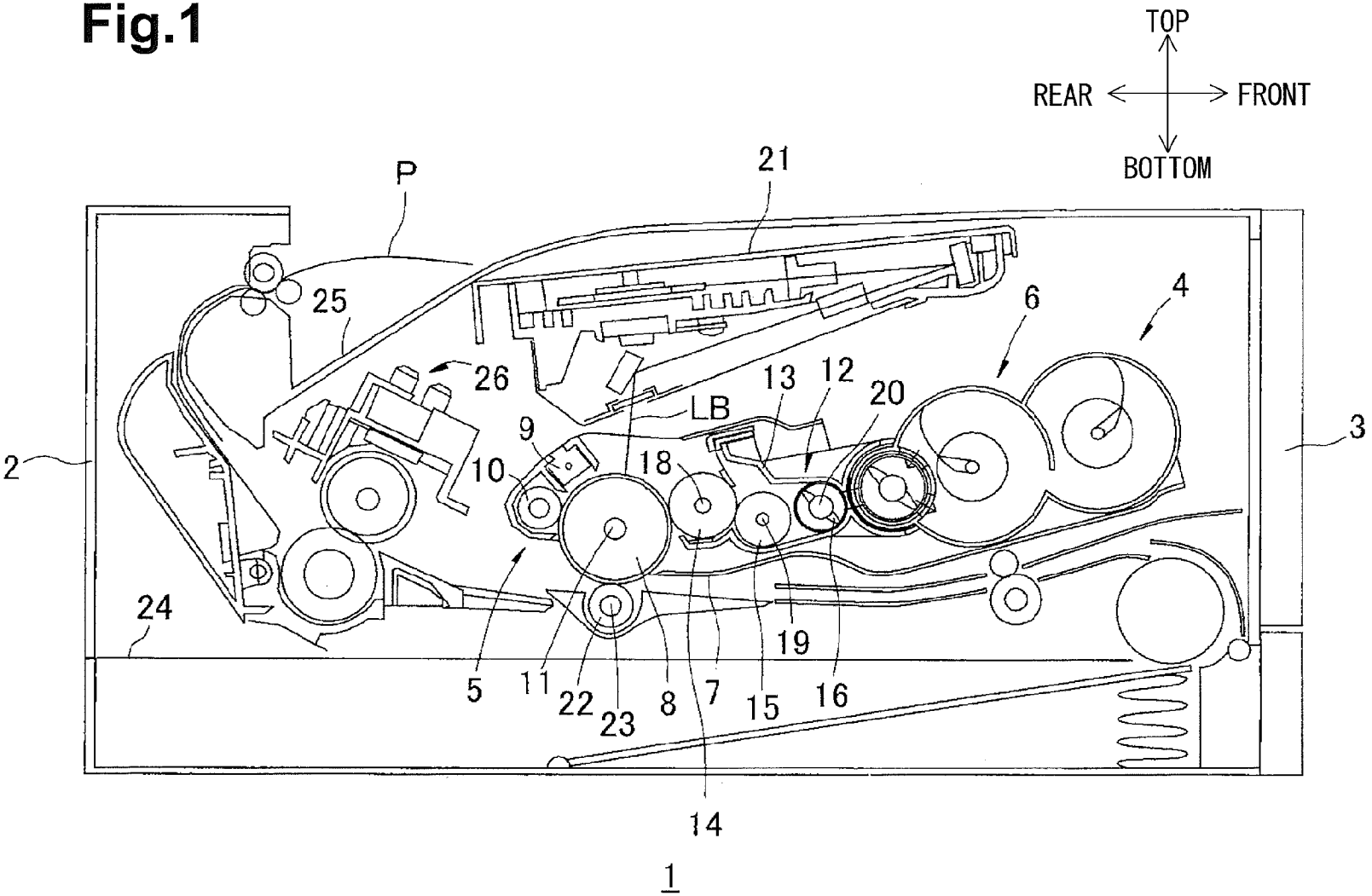
FIG. 1 is a sectional view of an image forming apparatus in which a process cartridge according to an embodiment of the invention is installed.

As illustrated in FIG. 1, a laser printer 1 is provided with a main body casing 2. A front cover 3 capable of being opened and closed is provided in the front of the main body casing 2.

In the following description, the front side of the laser printer 1 is regarded as the front side and the upper (above), lower (below), left and right directions of each component of the laser printer 1 are defined accordingly.

Figure 2:
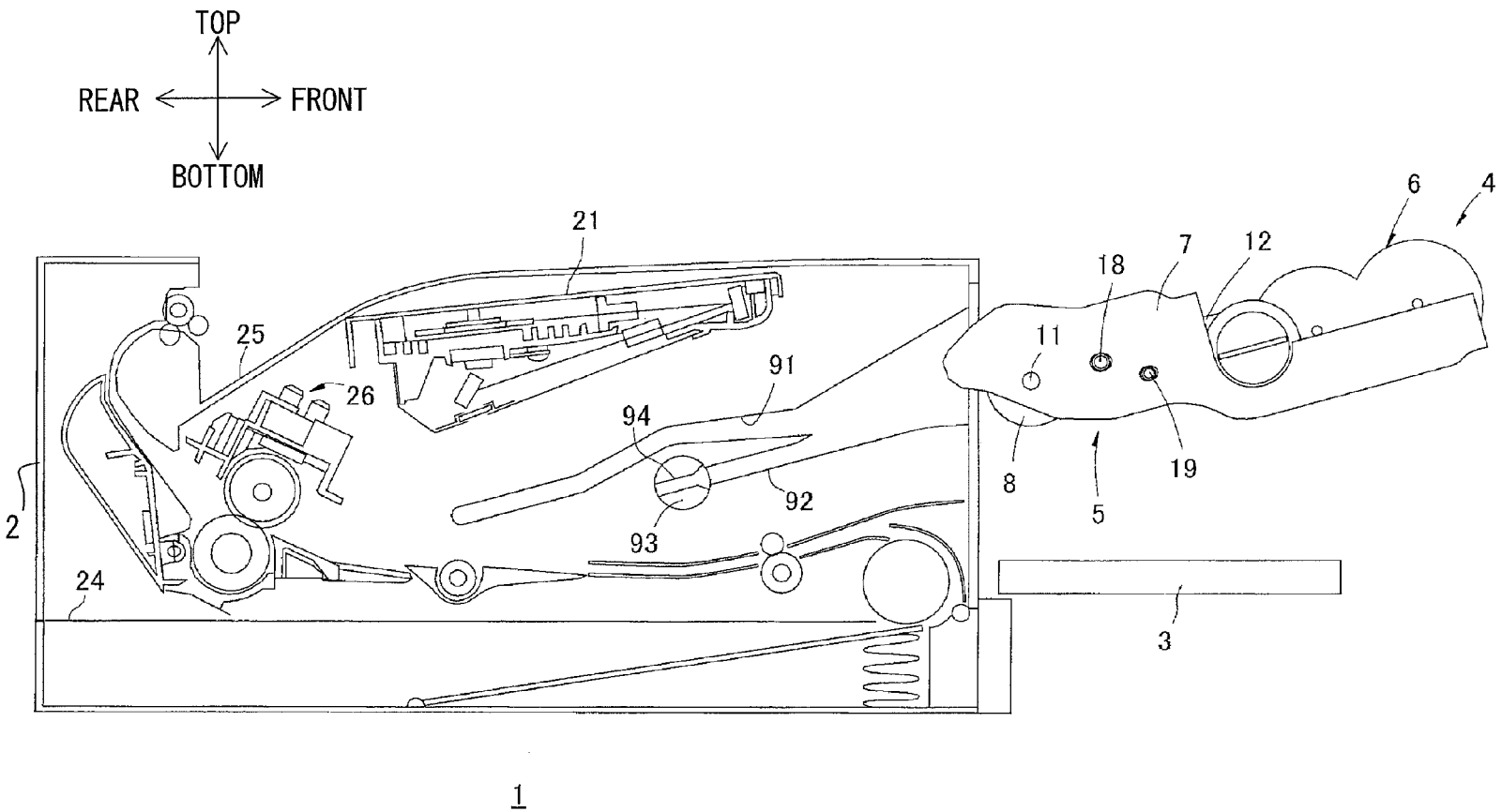
FIG. 2 is a sectional view of the image forming apparatus illustrated in FIG. 1 with a front cover opened and the process cartridge removed from a main body casing.

As illustrated in FIG. 2, a process cartridge 4 can be installed in and removed from the main body casing 2 when the front cover 3 is opened. The process cartridge 4 is constituted by a drum cartridge 5 which is an exemplary first cartridge and a toner cartridge 6 which is an exemplary second cartridge. The toner cartridge 6 is detachably attached to the drum cartridge 5 and contains toner.

The drum cartridge 5 is provided with a frame 7.

A photoconductor drum 8, a charging unit 9 and a cleaning unit 10 are supported at a rear end of the frame 7.

The photoconductor drum 8 is rotatable about a drum shaft 11 thereof which extends in a left-right direction, i.e., a width direction.

The charging unit 9 is disposed on the rear side, and the cleaning unit 10 is disposed on the upper rear side, of the photoconductor drum 8.

A developing unit 12 is supported by the frame 7 on the front side of the photoconductor drum 8. The developing unit 12 is provided with a development housing 13. A developing roller 14, a feed roller 15 and an auger 16 which are examples of a toner carrier are provided in the development housing 13.

The developing roller 14 is rotatable about a developing roller shaft 18 thereof which extends in the width direction. A peripheral surface of the developing roller 14 is partially exposed on the rear side of the development housing 13 and is in contact with a peripheral surface of the photoconductor drum 8 from the front side.

The feed roller 15 is disposed at a lower front side of the developing roller 14. The feed roller 15 is rotatable about a feed roller shaft 19 thereof which extends in the width direction. The peripheral surface of the feed roller 15 is in contact with the peripheral surface of the developing roller 14.

An auger 16 is disposed on the front side of the feed roller 15. The auger 16 is rotatable about an auger shaft 20 thereof which extends in the width direction.

Toner is supplied from the toner cartridge 6 to the development housing 13 in a state in which the toner cartridge 6 is attached to the drum cartridge 5. As the developing roller 14 and the feed roller 15 rotate, the toner in the development housing 13 is supplied from the peripheral surface of the feed roller 15 to the peripheral surface of the developing roller 14. The toner supplied to the developing roller 14 is carried on the developing roller 14 in the form of a thin layer of a certain thickness.

In the main body casing 2, an exposure unit 21 provided with, for example, laser is disposed above the process cartridge 4. The exposure unit 21 emits a laser beam LB toward a surface of the photoconductor drum 8.

At the time of image formation, the photoconductor drum 8 is rotated clockwise at a constant speed when seen from the left. As the photoconductor drum 8 is rotated, a surface (i.e., a peripheral surface) of the photoconductor drum 8 is uniformly charged by electric discharge from the charging unit 9 and then is exposed with the laser beam LB emitted from the exposure unit 21. With the exposure, the electric charge is selectively removed from the surface of the photoconductor drum 8 to form an electrostatic latent image on the surface of the photoconductor drum 8. When the electrostatic latent image opposes the developing roller 14 as the photoconductor drum 8 is rotated, toner is supplied to the electrostatic latent image from the developing roller 14. A toner image is then carried on the surface of the photoconductor drum 8.

In the main body casing 2, a transfer roller 22 is provided below the photoconductor drum 8. The transfer roller 22 is rotatable about a transfer roller shaft 23 thereof which extends in the width direction.

A paper cassette 24 containing paper sheets P is disposed at the bottom of the main body casing 2. An S-shaped sheet conveying path, when seen from the side, is formed in the main body casing 2. The sheet conveying path reaches a discharge tray 25 formed on a top surface of the main body casing 2 through between the photoconductor drum 8 and the transfer roller 22 from a front end of the paper cassette 24. The paper sheets P contained in the paper cassette 24 are fed one at a time from the paper cassette 24 with various rollers and conveyed on the sheet conveying path toward the discharge tray 25.

When the paper sheet P passes through between the photoconductor drum 8 and the transfer roller 22 on the sheet conveying path, the toner image carried on the surface of the photoconductor drum 8 is transferred to the paper sheet P. The paper sheet P having the toner image transferred thereto is sent to a fixing unit 26. In the fixing unit 26, the toner image is fixed on the paper sheet P as an image with heat and pressure. The paper sheet P having the image formed thereon is discharged to the discharge tray 25.

2. Drum Cartridge (1) Frame

Figure 3:
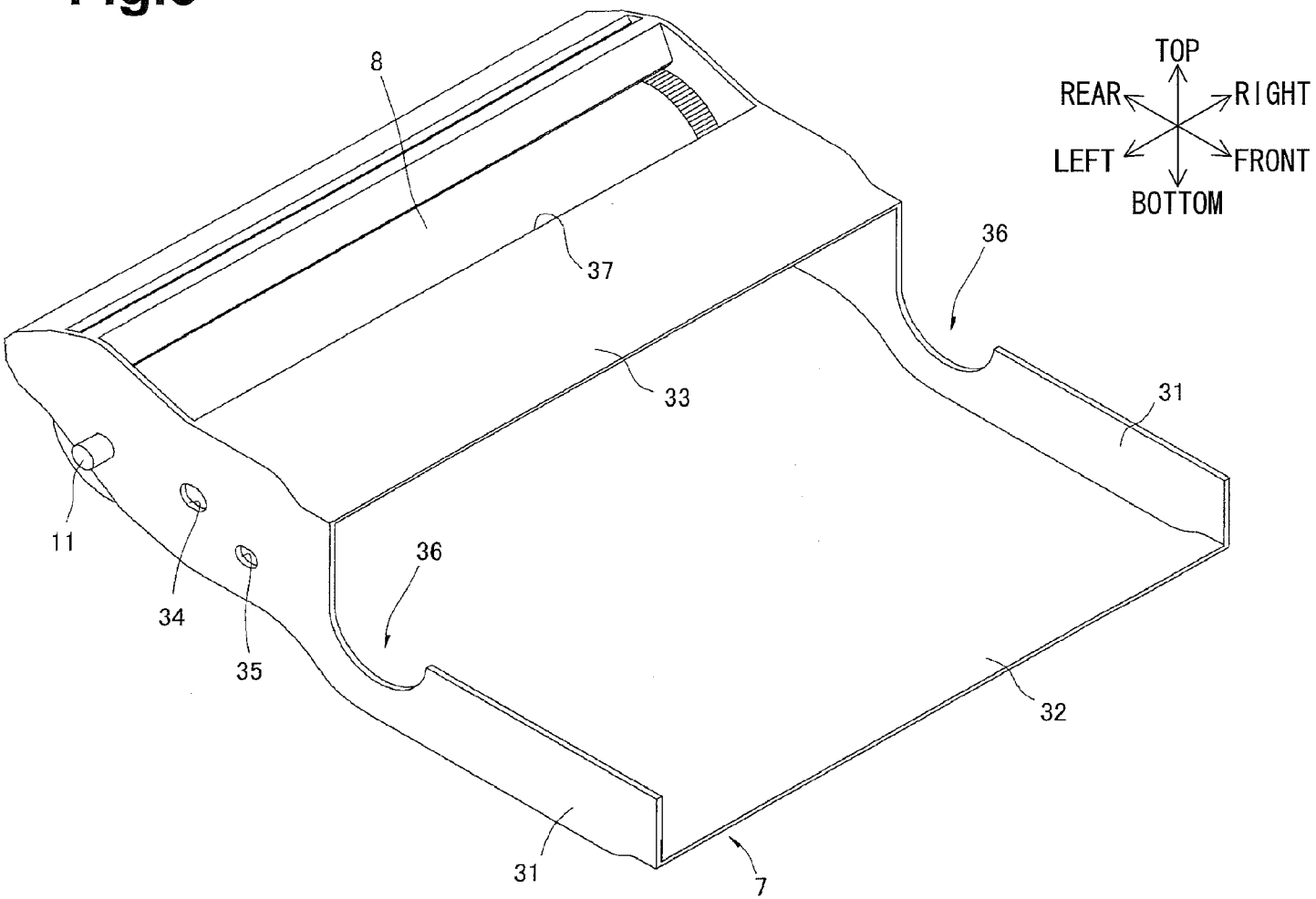
FIG. 3 is a perspective view of a frame of a drum cartridge illustrated in FIG. 1.

As illustrated in FIG. 3, the frame 7 of the drum cartridge 5 is provided with a pair of side plates 31, a bottom plate 32 and a top plate 33. The side plates 31 oppose each other in the width direction with a space formed therebetween. The bottom plate 32 is provided to extend between lower edges of the side plates 31. The top plate 33 is provided to extend between upper edges on the substantially rear halves of the side plates 31.

Ends of the drum shaft 11 of the photoconductor drum 8 penetrate rear ends of the side plates 31 and protrude outward from the side plates 31. Thus, the photoconductor drum 8 is rotatable about the drum shaft 11 while being held between the side plates 31.

A development bearing hole 34 is formed in each of the side plates 31 at a position spaced apart on the front side of the drum shaft 11. Ends of the developing roller shaft 18 of the developing roller 14 are rotatably inserted through the development bearing holes 34. The development bearing holes 34 are elongated holes formed to penetrate the side plates 31 and are larger in diameter in the front-rear direction than in the vertical direction.

A feed bearing hole 35 is formed in each of the side plates 31 at a position spaced downward and forward from the development bearing hole 34. Ends of the feed roller shaft 19 of the feed roller 15 are rotatably inserted through the feed bearing holes 35. The feed bearing holes 35 are elongated holes formed to penetrate the side plates 31 and are larger in diameter in the front-rear direction than in the vertical direction.

An upwardly opened, substantially U-shaped notch 36 is formed in each of the side plates 31 at a position spaced apart on the front side of the feed bearing hole 35.

The bottom plate 32 is provided to extend between the lower edges of the side plates 31 and between front edges of the side plates 31 and a position in which the bottom plate 32 opposes the peripheral surface of the photoconductor drum 8 from the front side. Thus, the peripheral surface of the photoconductor drum 8 is exposed downward on the rear side of the bottom plate 32.

The top plate 33 is provided to extend between the upper edges of the side plates 31 in a range between rear edges of the notches 36 and the rear ends of the side plates 31. A rear end of the top plate 33 extends downward along the rear edges of the side plates 31 so as to oppose the photoconductor drum 5 from the rear side. As illustrated in FIG. 1, the charging unit 9 and the cleaning unit 10 are accommodated in a rearwardly-convex portion of the top plate 33. As illustrated in FIG. 3, an opening 37 is formed to extend across the full width of the top plate 33 at a portion opposing the photoconductor drum 8 from above. Thus, the peripheral surface of the photoconductor drum 8 is exposed upward through the opening 37. The peripheral surface of the photoconductor drum 8 is irradiated with the laser beam LB (see FIG. 1) emitted from the exposure unit 21 through the opening 37.

(2) Developing Unit

Figure 4:
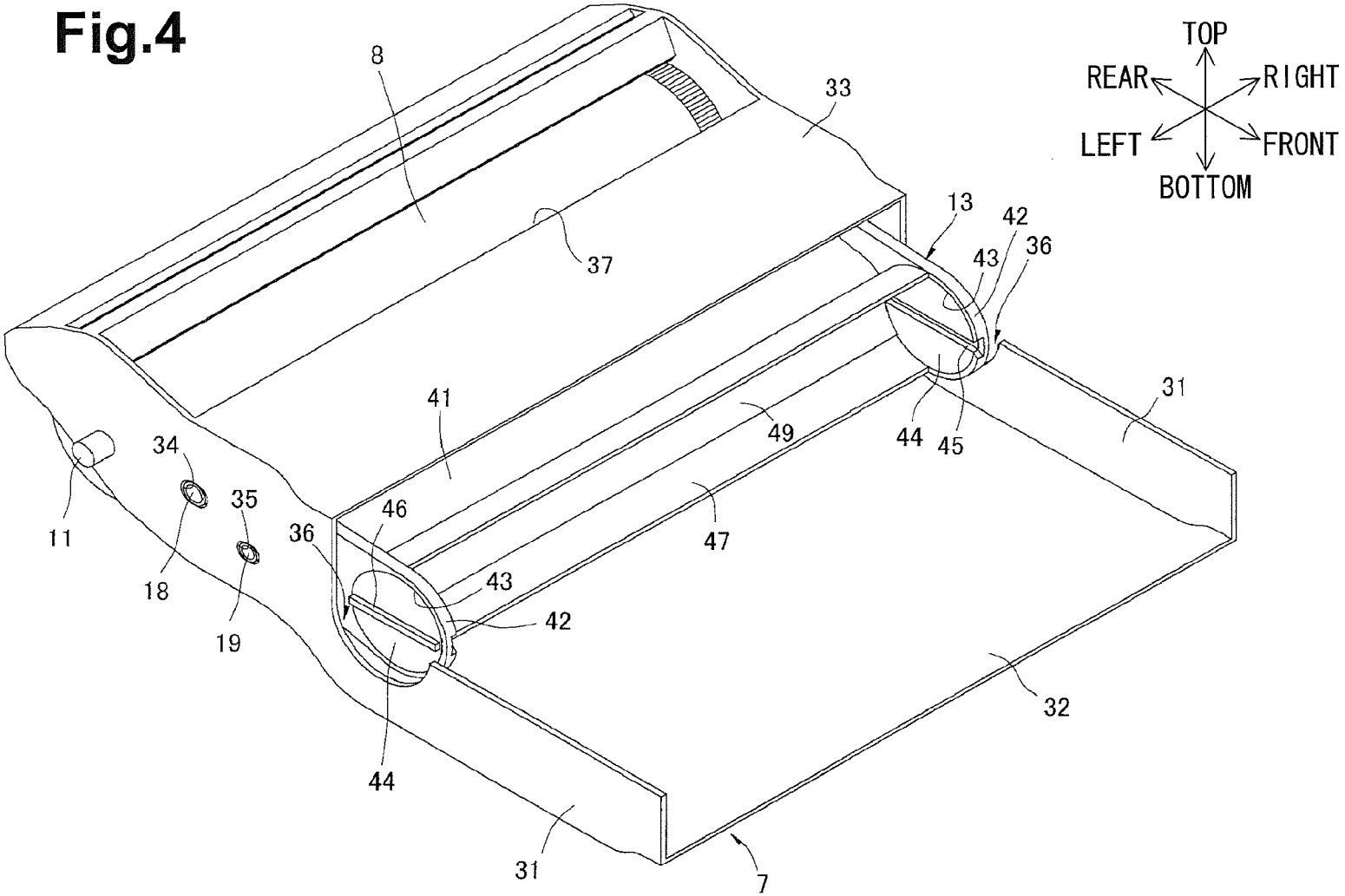
FIG. 4 is a perspective view of the drum cartridge illustrated in FIG. 1.

As illustrated in FIG. 4, the developing unit 12 is disposed between the side plates 31 to extend between a portion below the top plate 33 and a portion facing the notches 36 in the width direction. Ends of the developing roller shaft 18 of the developing roller 14 and ends of the feed roller shaft 19 of the feed roller 15 protrude outward in the width direction from the development housing 13, and are inserted in the development bearing holes 34 and the feed bearing holes 35, respectively. Thus, the developing unit 12 is supported by the frame 7 (i.e., the side plates 31) via the developing roller shaft 18 and the feed roller shaft 19.

The development housing 13 is provided with a main body 41 and plate-like inserting portions 42 which are integrated with one another. The main body 41 accommodates the developing roller 14, the feed roller 15 and the auger 16 (see FIG. 1). The plate-like inserting portions 42 extend forward from ends in the width direction of the main body 41.

The inserting portions 42 extend to reach positions to oppose the notches 36 of the frame 7 in the width direction. A circular holding hole 43 is formed to penetrate each of the inserting portions 42.

Disc-shaped first manipulation members 44 are fit into and rotatably supported by the holding hole 43. A first engaging portion 45 is formed as a recessed groove on an inner surface of each of the first manipulation members 44. The first engaging portion 45 extends across the full diameter of the first manipulation member 44. A second engaging portion 46 is formed as a protrusion on an outer surface of each of the first manipulation members 44. The second engaging portion 46 overlaps the first engaging portion 45 in the width direction and extends across the full diameter of the first manipulation member 44.

The development housing 13 is provided with a circular arc plate-shaped first wall 47 formed along a rear half of a peripheral edge of the holding hole 43. The first wall 47 is provided to extend between the inserting portions 42. A circumferential central portion of the first wall 47 is integrated with the main body 41. Rectangular first openings 48 (see FIG. 8) elongated in the width direction are formed in the central portion and ends in the width direction of the first wall 47. Thus, the inside and outside of the main body 41 communicate with each other through the first openings 48.

A circular arc plate-shaped first opening and closing member 49 is formed at the front side of the first wall 47. Ends in the width direction of the first opening and closing member 49 are connected to the first manipulation members 44. Thus, the first opening and closing member 49 can be moved integrally with the first manipulation members 44. A circumferential central portion of the first opening and closing member 49 is located at the same position as those of one ends of the first engaging portions 45 and the second engaging portions 46.

3. Toner Cartridge

Figure 5:
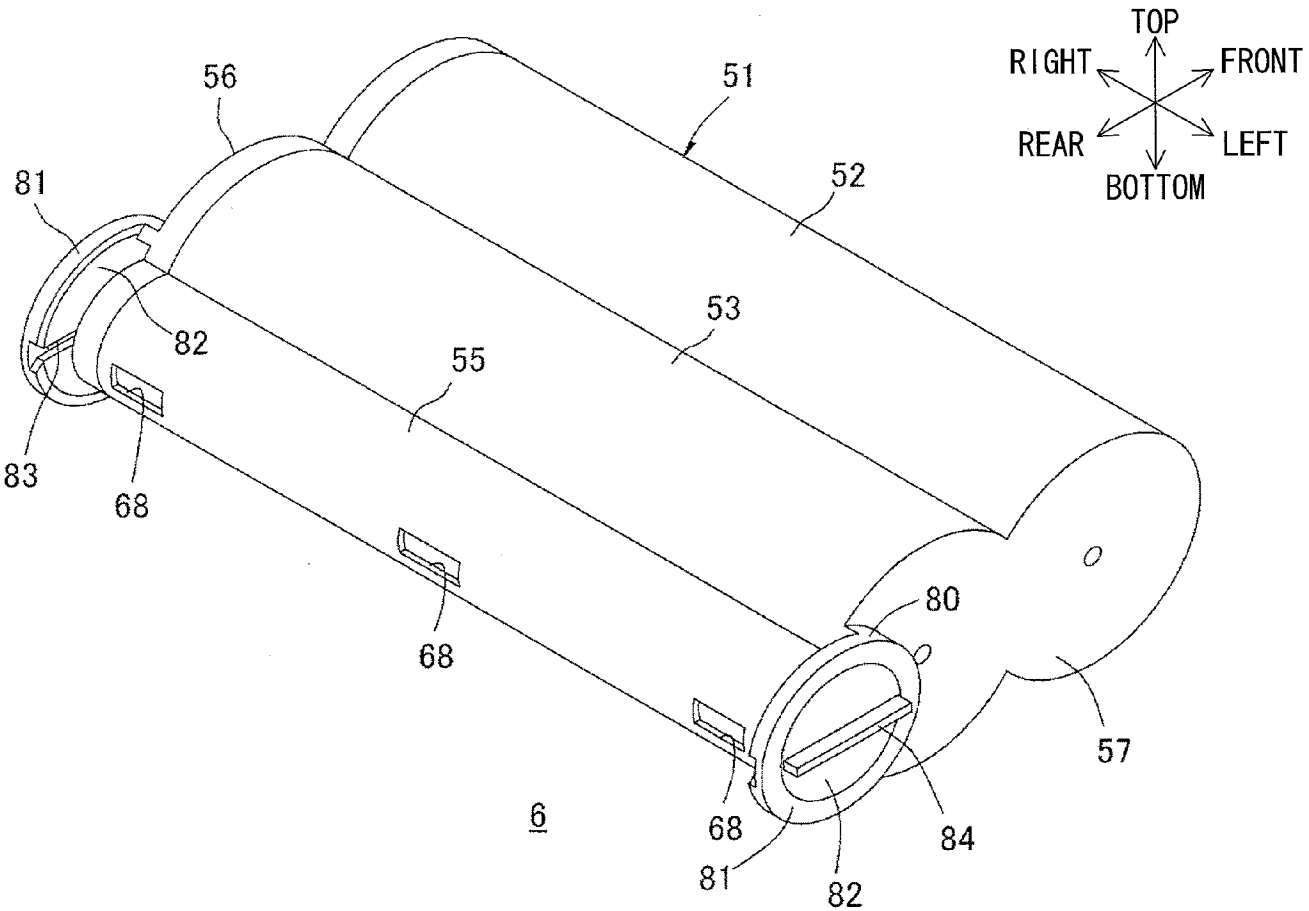
FIG. 5 is a perspective view of a toner cartridge illustrated in FIG. 1.
Figure 6:
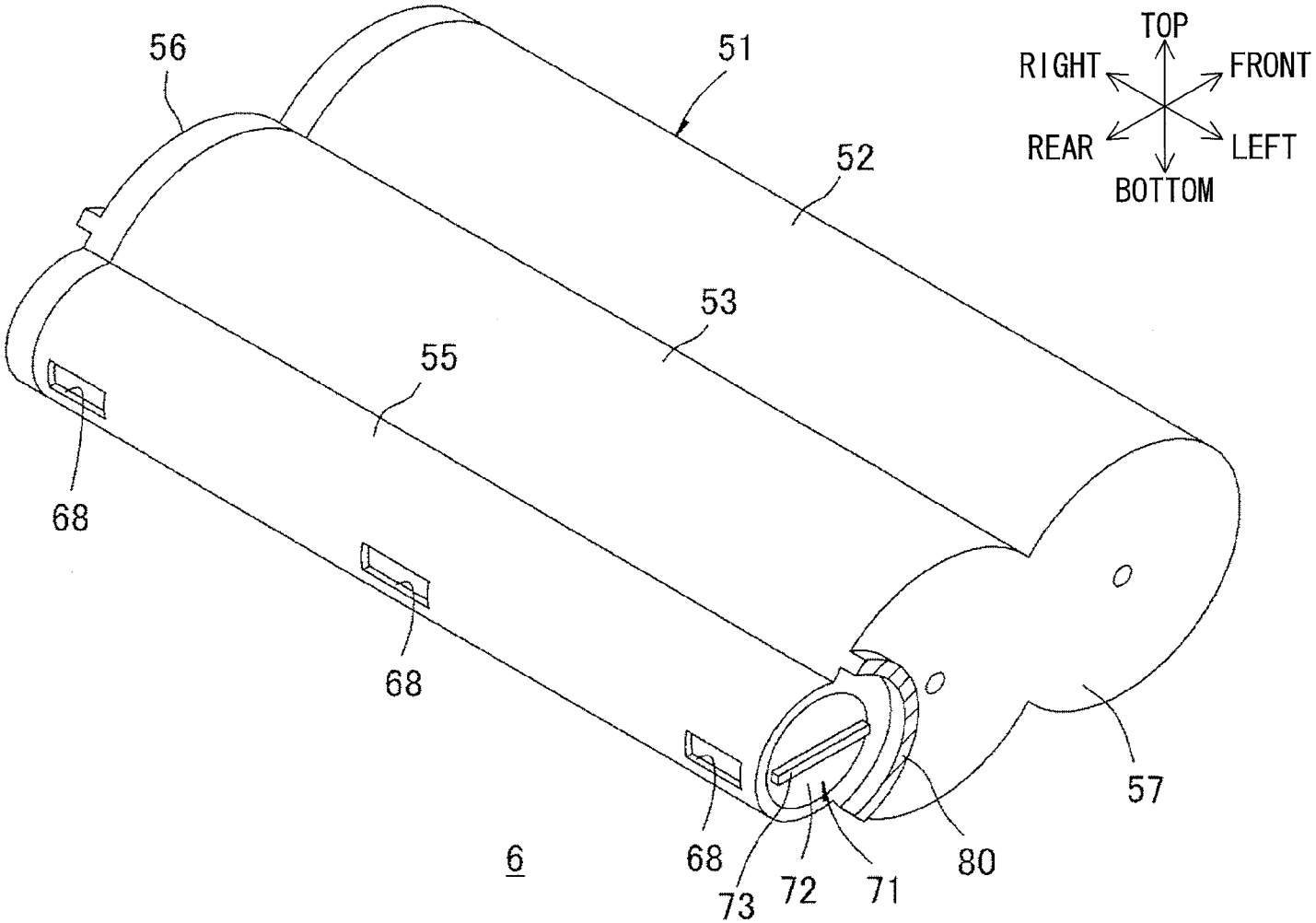
FIG. 6 is a perspective view of the toner cartridge illustrated in FIG. 5 with a ring portion and a third manipulation member being cut away.
Figure 7:
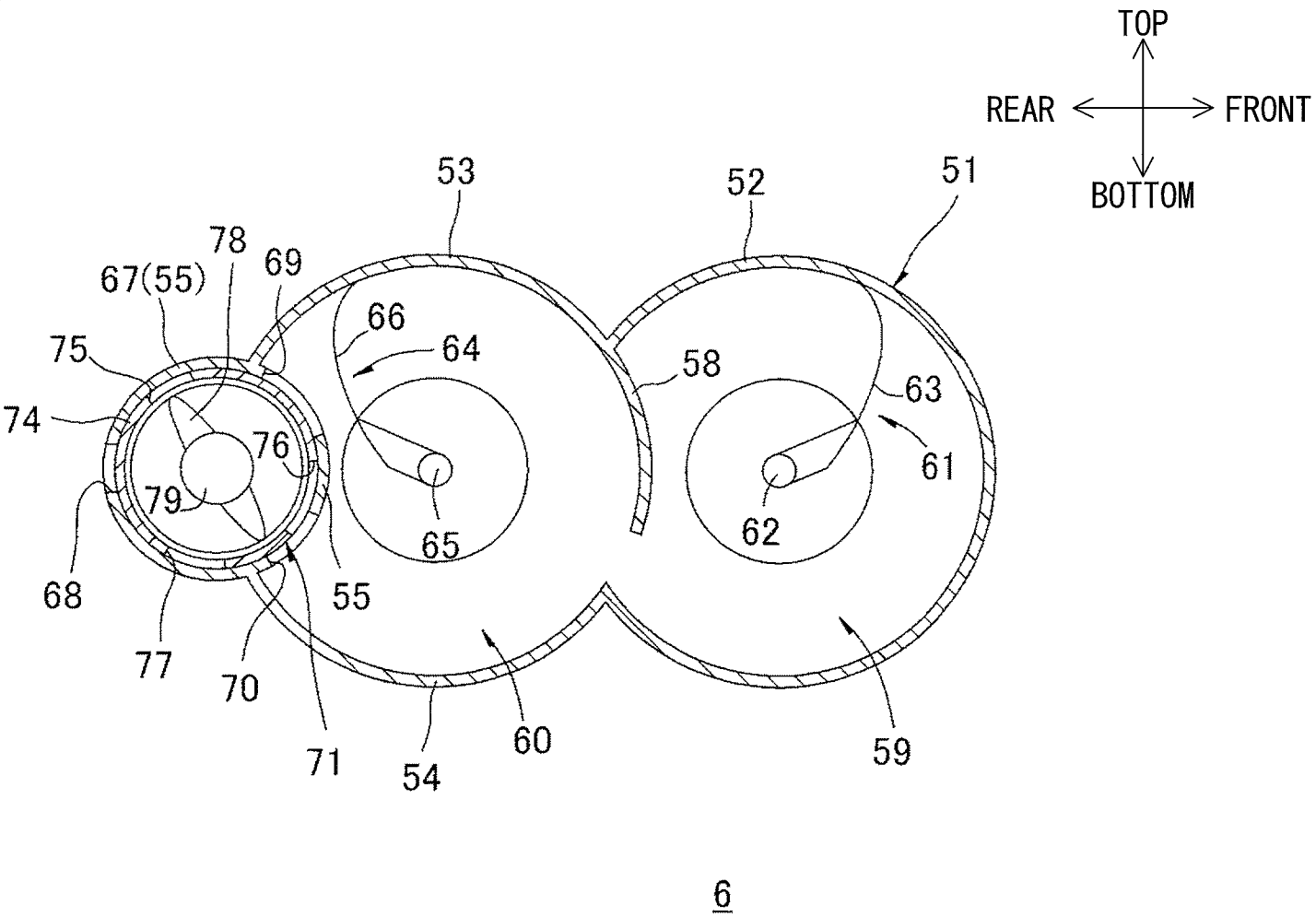
FIG. 7 is a sectional view of the toner cartridge illustrated in FIG. 5.

As illustrated in FIGS. 5 and 6, the toner cartridge 6 includes a cartridge case 51 which is an exemplary housing. The cartridge case 51 is constituted by three hollow cylindrical members connected in the radial direction thereof. In particular, the cartridge case 51 is provided with, as illustrated in FIG. 7, a first peripheral wall 52, a first circular arc wall 53, a second circular arc wall 54, a cylindrical wall 55, a left side wall 56 and a right side wall 57 which are integrated with one another. The first peripheral wall 52 extends in the width direction and has a backwardly open C-shaped cross section. The first circular arc wall 53 continues to an upper rear end of the first peripheral wall 52 and has an upwardly-convex circular arc cross section. The second circular arc wall 54 continues to a lower rear end of the first peripheral wall 52 and has a downwardly-convex circular arc cross section. Rear ends of the first circular arc wall 53 and the second circular arc wall 54 are connected to the cylindrical wall 55 which has a circular cross section. The left side wall 56 and the right side wall 57 are formed to enclose from the left and right a space surrounded by the first peripheral wall 52, the first circular arc wall 53 and the second circular arc wall 54.

The cartridge case 51 includes a circular arc plate-shaped partition wall 58. The partition wall 58 extends downward along a circumferential direction of the first circular arc wall 53 from a connecting portion of the first peripheral wall 52 and the first circular arc wall 53. Ends in the width direction of the partition wall 58 are connected to the left side wall 56 and the right side wall 57. A space is formed between a lower end of the partition wall 58 and a connecting portion of the first peripheral wall 52 and the second circular arc wall 54. A space surrounded by the first peripheral wall 52 and a space defined between the first circular arc wall 53 and the second circular arc wall 54 are partitioned by the partition wall 58 as a first toner container 59 and a second toner container 60, respectively. The first toner container 59 and the second toner container 60 communicate with each other through between the lower end of the partition wall 58 and the connecting portion of the first peripheral wall 52 and the second circular arc wall 54.

An agitator 61 is accommodated in the first toner container 59. The agitator 61 is provided with an agitator shaft 62 rotatably supported by the left side wall 56 and the right side wall 57, and a stirring film 63 supported by the agitator shaft 62.

An agitator 64 is accommodated in the second toner container 60. The agitator 64 is provided with an agitator shaft 65 rotatably supported by the left side wall 56 and the right side wall 57, and a stirring film 66 supported by the agitator shaft 65.

A portion of the cylindrical wall 55 exposed outside is formed as a second wall 67 which is disposed adjacent to the first wall 47 of the developing unit 12 in a state in which the toner cartridge 6 is attached to the drum cartridge 5. Three rectangular second openings 68 which are elongated in the width direction are formed in a central portion and both ends in a width direction in a circumferential central portion of the second wall 67 so as to correspond to three first openings 48 (see FIG. 8) formed in the first wall 47. Thus, the three second openings 68 oppose the first openings 48 in a state in which the toner cartridge 6 is attached to the drum cartridge 5.

A toner supply port 69 and a toner return port 70 are formed in a portion located inside the cartridge case 51 of the cylindrical wall 55. The toner supply port 69 and the toner return port 70 are spaced apart from each other in the circumferential direction of the cylindrical wall 55 and are formed to extend across the full width of the cylindrical wall 55.

A hollow cylindrical cylinder 71 is rotatably provided in the cylindrical wall 55. The cylinder 71 has a dimension in the width direction which is substantially the same as that of the cylindrical wall 55. Outer surfaces of side walls 72 of both ends in the width direction of the cylinder 71 are on substantially the same surface as those of end surfaces in the width direction of the cylindrical wall 55, as illustrated in FIG. 6. A first portion to be engaged 73 which is engageable with the first engaging portion 45 is formed on each of the outer surfaces of the side walls 72 which are exemplary manipulation member and second manipulation member. The first portion to be engaged 73 is formed as a protrusion extending along the diameter of each of the end walls 72.

As illustrated in FIG. 7, a cylinder side toner supply port 76 and a cylinder side toner return port 77 are formed in a peripheral wall 74 of the cylinder 71 to respectively correspond to the toner supply port 69 and the toner return port 70. Three cylinder openings 75 are formed in the peripheral wall 74 which are exemplary opening and closing member and second opening and closing member to correspond to the three second openings 68.

An auger 78 is provided in the cylinder 71. The auger 78 is rotatable about an auger shaft 79 thereof which extends in the width direction.

As illustrated in FIGS. 5 and 6, a protruding wall 80 is formed to protrude from each of the outer surfaces at rear ends of the left side wall 56 and the right side wall 57 of the cartridge case 51 and on the front side of the cylindrical wall 55. The protruding wall 80 has a circular arc cross section and extends in the circumferential direction of the cylindrical wall 55. As illustrated in FIG. 5, a ring-shaped (i.e., annular) ring portion 81 is formed at an end portion (i.e., an outer end portion in the width direction) of the protruding wall 80 so as to be coaxial with the cylindrical wall 55.

A disc-shaped third manipulation member 82 which is an exemplary protection member is fit into and rotatably supported by each of the ring portions 81. With this, the third manipulation member 82 opposes the side wall 72 in the width direction from the outside with a space formed therebetween. A second portion to be engaged 83 which is engageable with the second engaging portion 46 is formed as a recessed groove on an inner surface of the third manipulation member 82. The second portion to be engaged 83 extends across the full diameter of third manipulation member 82. An input section 84 is formed as a protrusion on an outer surface of the third manipulation member 82. The input section 84 overlaps the second portion to be engaged 83 in the width direction and extends across the full diameter of the third manipulation member 82.

4. Operation (1) Attachment of Toner Cartridge

Figure 8:
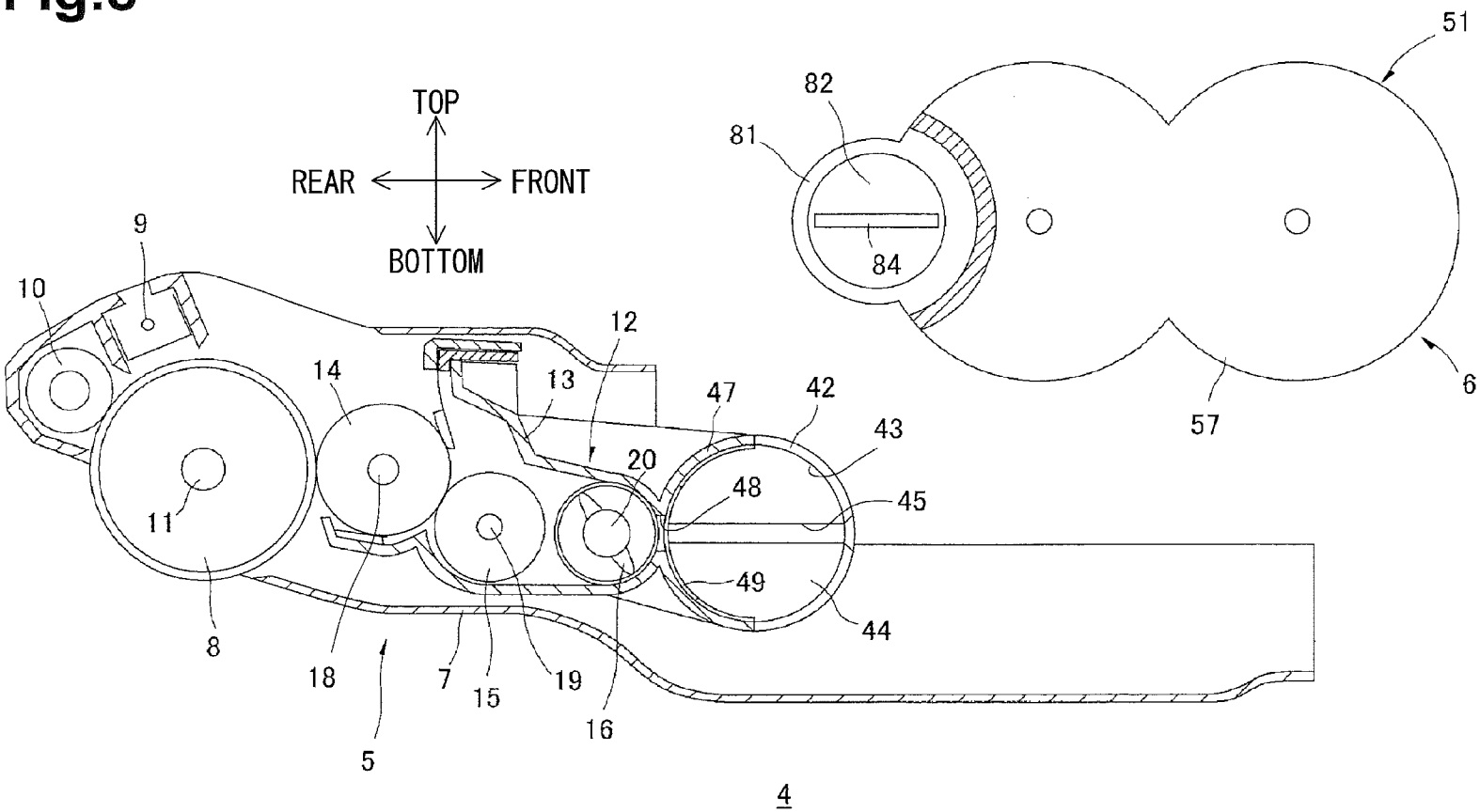
FIG. 8 is a sectional view of the drum cartridge illustrated in FIG. 4, additionally illustrating the toner cartridge illustrated in FIG. 6 in a side view.

As illustrated in FIG. 8, in a state in which the toner cartridge 6 is removed from the drum cartridge 5, the first engaging portions 45 and the second engaging portions 46 formed in the first manipulation members 44 extend in the front-rear direction in the drum cartridge 5. In the toner cartridge 6, the first portions to be engaged 73 formed in the side walls 72 of the cylinder 71 extend in the front-rear direction as illustrated in FIG. 6 and the second portions to be engaged 83 and the input sections 84 formed in the third manipulation members 82 extend in the front-rear direction as illustrated in FIGS. 5 and 8.

The toner cartridge 6 is attached to the drum cartridge 5 from the front side. At the time of the attachment, the toner cartridge 6 is disposed on the front side of the drum cartridge 5. The drum cartridge 5 and the toner cartridge 6 are aligned in the vertical direction with each other such that the first portions to be engaged 73 and the first engaging portions 45 are on the same line and the second portions to be engaged 83 an the second engaging portions 46 are on the same line. Then, the toner cartridge 6 is moved to the rear direction which is an exemplary predetermined attachment direction to come close to the drum cartridge 5. As the toner cartridge 6 is moved, the first portions to be engaged 73 enter the first engaging portions 45 and the second engaging portions 46 enter the second portions to be engaged 83. The first portions to be engaged 73 are then moved along the first engaging portions 45 and the second portions to be engaged 83 are moved along the second engaging portions 46. In this manner, the movement of the toner cartridge 6 with respect to the drum cartridge 5 is guided.

Figure 9:
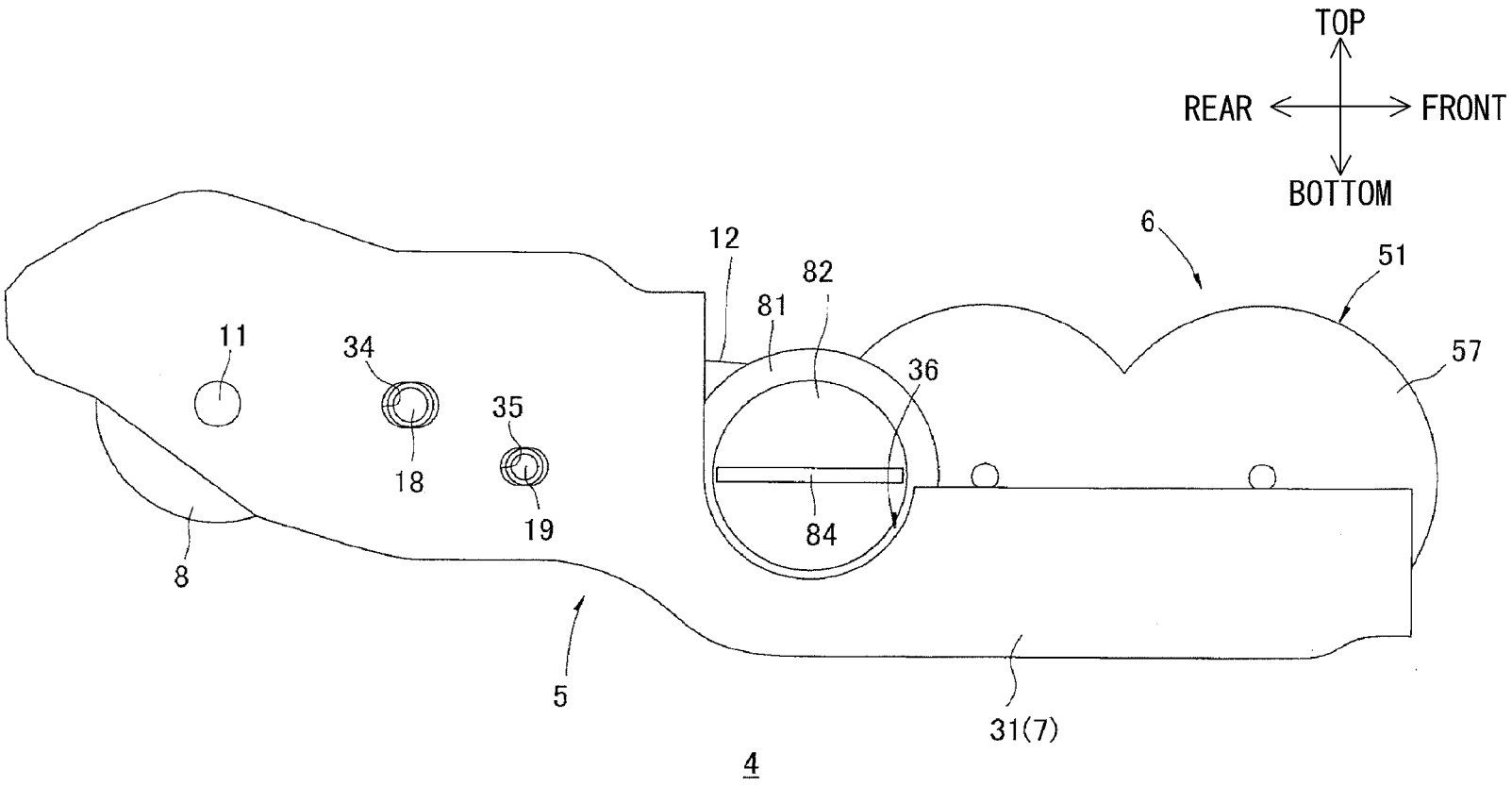
FIG. 9 is a side view of the process cartridge illustrated in FIG. 1.
Figure 10:
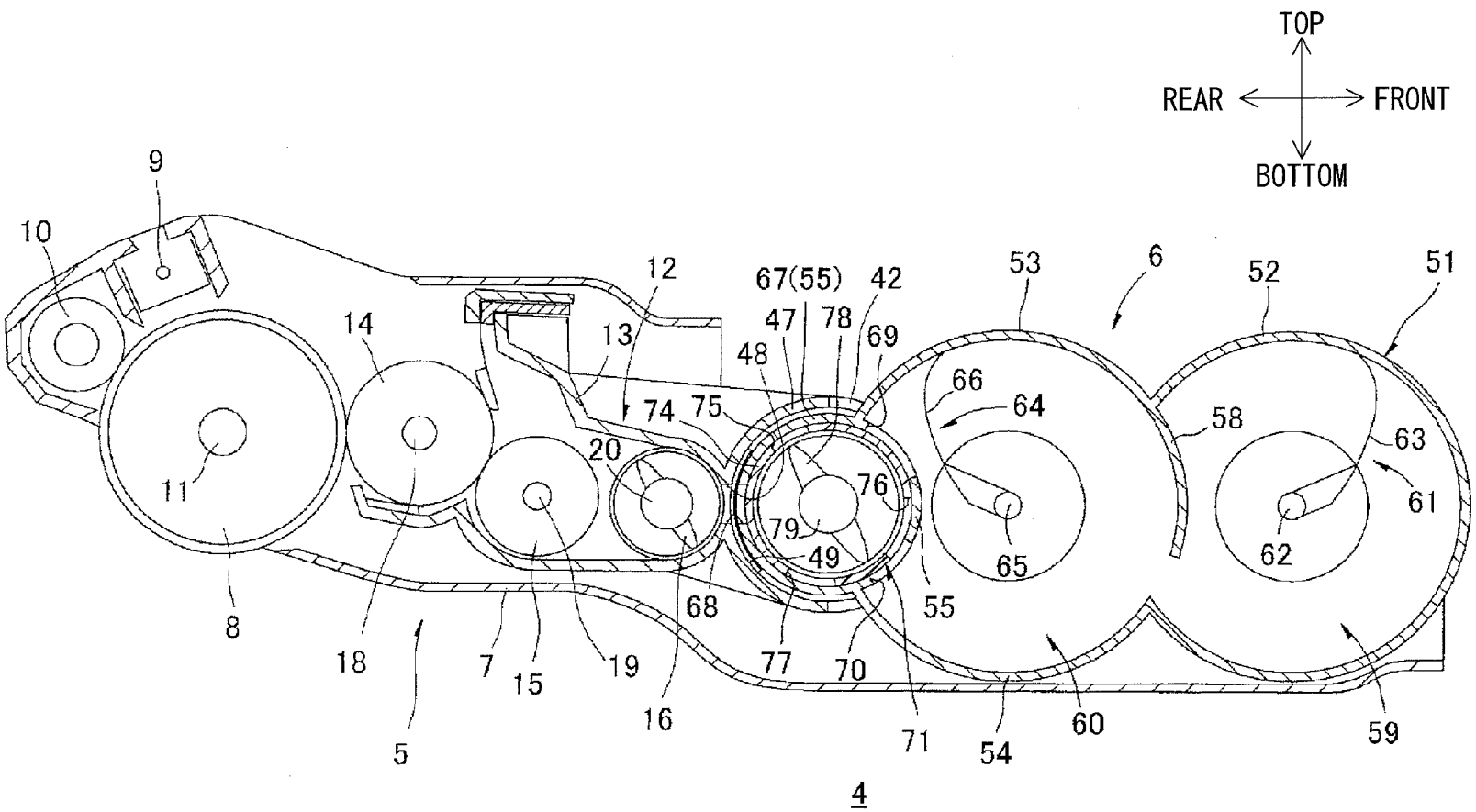
FIG. 10 is a sectional view of the process cartridge illustrated in FIG. 9, with a first opening and a second opening closed.

Upon completion of attachment of the toner cartridge 6 to the drum cartridge 5, as illustrated in FIG. 9, the third manipulation members 82 oppose the notches 36 of the frame 7 in the width direction and the input sections 84 formed in the third manipulation members 82 are exposed in the width direction outside through the notches 36. Immediately after the completion of the attachment, as illustrated in FIG. 10, the first opening and closing member 49 opposes the first openings 48 and the first openings 48 and the second opening 68 oppose each other via the first opening and closing member 49. The cylinder openings 75 of the cylinder 71 do not oppose the second openings 68 of the second wall 67 of the cartridge case 51 and the second openings 68 are closed by the peripheral wall 74 of the cylinder 71. The position of the peripheral wall 74 of the cylinder 71 at this time is an exemplary closed position and the position of each of the side walls 72 of the cylinder 71 is an exemplary second position.

(2) Installation of Process Cartridge

The process cartridge 4, which is integrally constituted by the toner cartridge 6 attached to the drum cartridge 5, is installed in the main body casing 2 in a state in which the front cover 3 is opened as illustrated in FIG. 2.

Guide grooves 91 for guiding the process cartridge 4 to be installed in and removed from main body casing 2 are formed on opposing inner surfaces of the main body casing 2 in the width direction. The width of each of the guide grooves 91 in the vertical direction is the maximum in a front end of the guide groove 91, decreases as it approaches the rear side, and becomes substantially constant from the middle of the front-rear direction. The portion of each of the guide grooves 91 with the substantially constant width in the vertical direction extends rearward, bends downward and rearward, bends again to reduce the inclination and extends downward and rearward. A rear end of each of the guide grooves 91 is located at a central portion of the main body casing 2 in the vertical direction and at a position slightly rearward from the central portion in the main body casing 2 in the front-rear direction.

Branch grooves 92 which are branched from the guide grooves 91 are formed on the inner surfaces of the main body casing 2. The branch grooves 92 extend downward and rearward on the rear side of the guide grooves 91. A disc-shaped portion 93 is provided on the rear side of each of the branch grooves 92 and below each of the guide grooves 91 where each of the guide grooves 91 bends between the portion extending rearward and the portion extending downward and rearward. The disc-shaped portion 93 is rotatable about a central axis thereof. Fitting grooves 94 into which the input sections 84 of the process cartridge 4 can fit are formed on the inner surfaces in the width direction of the disc-shaped portions 93. Each of the fitting grooves 94 extends rearward continuing from the branch groove 92.

At the time of installing the process cartridge 4 in the main body casing 2, the ends of the drum shaft 11 protruding outward in the width direction from the side plates 31 of the frame 7 are inserted in the guide grooves 91. The process cartridge 4 is then moved rearward and the ends of the drum shaft 11 are moved along the guide grooves 91. The movement of the process cartridge 4 is thus guided and the process cartridge 4 is moved downward as it is moved rearward. At this time, the input sections 84 enter the branch grooves 92 and are moved toward the fitting grooves 94 of the disc-shaped portions 93 while being guided by the branch grooves 92. When the ends of the drum shaft 11 reach rear ends of the guide grooves 91, the installation of the process cartridge 4 in the main body casing 2 is completed and the input sections 84 fit into the fitting grooves 94.

(3) Opening of Shutter

Figure 11:
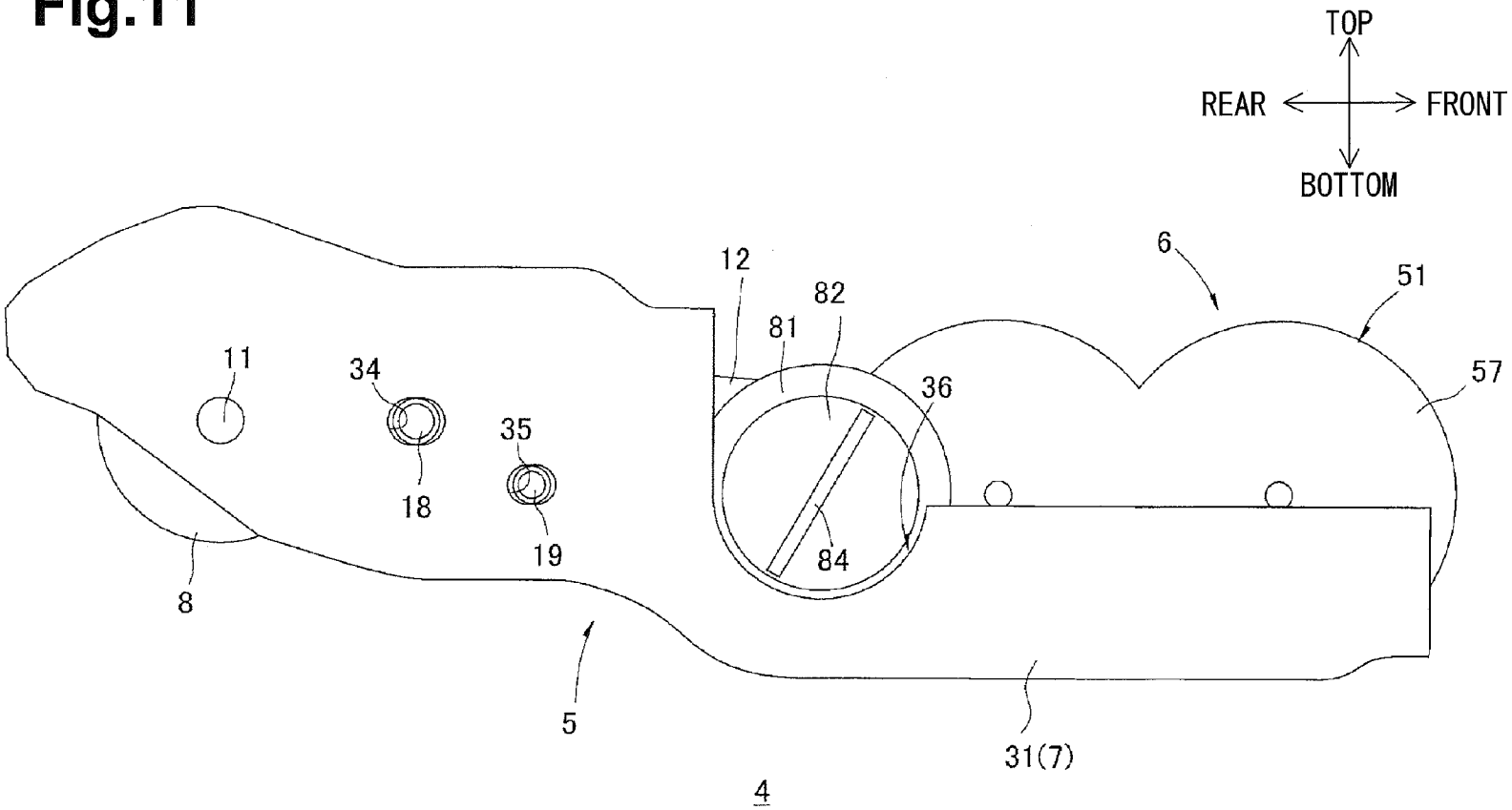
FIG. 11 is a side view of the process cartridge illustrated in FIG. 1.

When the front cover 3 is closed upon completion of the installation of the process cartridge 4, the disc-shaped portions 93 are rotated by a driving mechanism (not illustrated) provided in the main body casing 2 and the input sections 84 of the third manipulation members 82 are manipulated by the fitting grooves 94, whereby the third manipulation members 82 are rotated counterclockwise when seen from the left as illustrated in FIG. 11. When the first portions to be engaged 73 and the first engaging portions 45 engage one another and the second portions to be engaged 83 and the second engaging portions 46 engage one another, the side walls 72 of the cylinder 71 and the third manipulation members 82 are connected via the first manipulation members 44. Thus, when the third manipulation members 82 are rotated, the first manipulation members 44 and the cylinder 71 (i.e., the side walls 72) are rotated integrally with the third manipulation members 82. The first opening and closing member 49 is moved downward integrally with the side walls 72.

Figure 12:
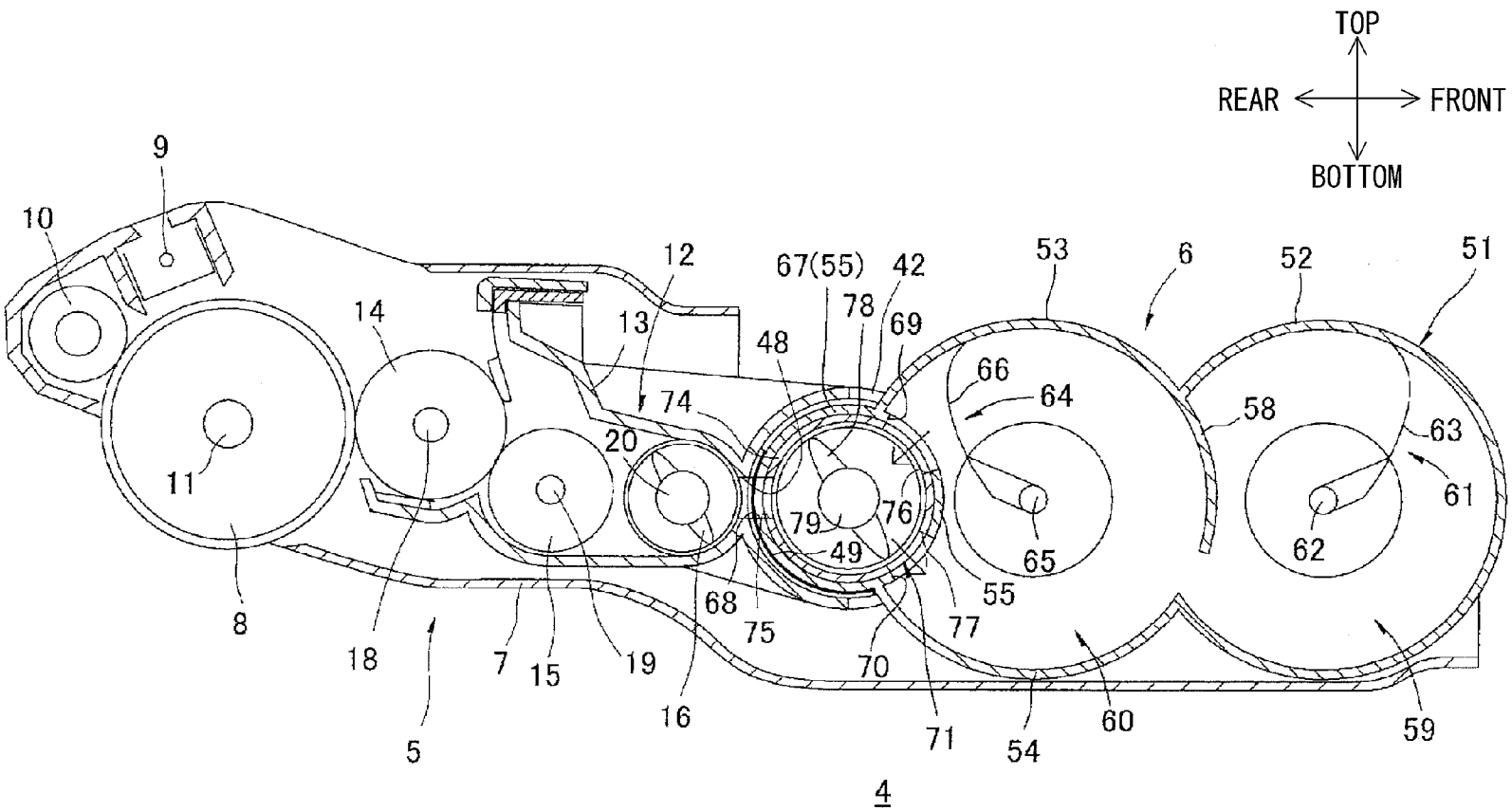
FIG. 12 is a sectional view of the process cartridge illustrated in FIG. 11, with the first opening and the second opening opened.

When the third manipulation members 82 are rotated a predetermined angle, as illustrated in FIG. 12, an upper edge of the first opening and closing member 49 is disposed below lower edges of the first openings 48. Thus, the first openings 48 are opened and the first openings 48 and the second openings 68 oppose and communicate with one another. The cylinder openings 75 of the cylinder 71 oppose and communicate with the second openings 68. Thus, the inside of the development housing 13 and the cylinder 71 communicate with each other through the first openings 48, the second openings 68 and the cylinder openings 75. As the cylinder 71 is rotated, the cylinder side toner supply port 76 and the cylinder side toner return port 77 oppose the toner supply port 69 and the toner return port 70, respectively. Thus, the inside of the second toner container 60 and the cylinder 71 communicate with each other. The position of the peripheral wall 74 of the cylinder 71 at this time is an exemplary open position and the position of each of the side walls 72 of the cylinder 71 is an exemplary first position.

(4) Stirring and Circulation of Toner

Then, the agitators 61 and 64 and the augers 16 and 78 are rotated.

The agitator 61 is rotated clockwise when seen from the left. As the agitator 61 is rotated, the toner contained in the first toner container 59 is supplied to the second toner container 60 through between the lower end of the partition wall 58 and a connecting portion of the first peripheral wall 52 and the second circular arc wall 54 while being agitated.

The agitator 64 is rotated counterclockwise when seen from the left. As the agitator 64 is rotated, the toner in the second toner container 60 is supplied to the cylinder 71 through the toner supply port 69 and the cylinder side toner supply port 76 while being agitated. The toner in the second toner container 60 is returned to the first toner container 59 through between the lower end of the partition wall 58 and the connecting portion of the first peripheral wall 52 and the second circular arc wall 54. In this manner, the toner circulates between the first toner container 59 and the second toner container 60.

As the auger 78 is rotated, the toner in the cylinder 71 is moved to a central portion of the cylinder 71 in the width direction and is supplied to the development housing 13 through the central cylinder openings 75, the second openings 68 and the first openings 48.

As the auger 16 is rotated, the toner in the development housing 13 is moved toward both sides in the width direction of the development housing 13 and is returned to the cylinder 71 through the first openings 48, the second openings 68 and the cylinder openings 75 of both sides.

With this operation, the toner circulates between the inside of the toner cartridge 6 and the inside of the development housing 13 while being agitated in the toner cartridge 6.

(5) Removal of Process Cartridge

When the front cover 3 of the process cartridge 4 is opened, the disc-shaped portions 93 are rotated by the driving mechanism (not illustrated) provided in the main body casing 2 and the fitting grooves 94 are moved to positions to continue to the branch grooves 92. The input sections 84 of the third manipulation members 82 fit in the fitting grooves 94 are rotated clockwise when seen from the left and, as illustrated in FIG. 9, the input sections 84 are returned to the position extending in the front-rear direction. In this manner, the first opening and closing member 49 opposes the first openings 48 and the peripheral wall 74 of the cylinder 71 opposes the second openings 68. Thus, the first openings 48 and the second openings 68 are closed by the first opening and closing member 49 and the peripheral wall 74, respectively.

The process cartridge 4 is then moved forward. At this time, both ends of the drum shaft 11 are moved along the guide grooves 91. With this guiding, the process cartridge 4 is moved upward as it is moved forward and is removed from the main body casing 2.

Alternatively, the input sections 84 may be rotated by a manual manipulation to open and close the first openings 48 and the second openings 68 in a state in which the process cartridge 4 is removed from the inside of the main body casing 2. In this case, the branch grooves 92, the disc-shaped portions 93 and the fitting grooves 94 are unnecessary.

5. Operation and Effects (1) Operation and Effect 1

In the toner cartridge 6, the peripheral wall 74 of the cylinder 71 is provided to be movable to open and close the second openings 68 formed in the cartridge case 51. The first portions to be engaged 73 are provided in the side walls 72 of the cylinder 71. When the toner cartridge 6 is not attached to the drum cartridge 5, each of the first portions to be engaged 73 of the toner cartridge 6 is an exemplary manipulation member. The third manipulation members 82 are provided to oppose the first portions to be engaged 73 from the outside with spaces formed therebetween. With this, undesirable contact of other members with the first portions to be engaged 73 can be prevented. Accordingly, accidental opening of the second openings 68 can be prevented.

(2) Operation and Effect 2

The process cartridge 4 is provided with the drum cartridge 5 and the toner cartridge 6 which is attached to the drum cartridge 5.

The drum cartridge 5 is provided with the developing unit 12. The developing roller 14 which carries the toner is supported by the developing unit 12. The development housing 13 of the developing unit 12 is provided with the first wall 47 disposed along the width direction. The first openings 48 are formed in the first wall 47. The first opening and closing member 49 is provided to be movable to open and close the first openings 48. The toner cartridge 6 is provided with the first manipulation members 44. The first manipulation members 44 are manipulated to open and close the first openings 48.

The toner cartridge 6 is provided with the cartridge case 51 which is an exemplary housing which contains toner. The cartridge case 51 is provided with the second wall 67. The second wall 67 is disposed adjacent to the first wall 47 in a state in which the toner cartridge 6 is attached to the drum cartridge 5. The second openings 68 are formed in the second wall 67 at a position corresponding to the first openings 48 of the drum cartridge 5. The peripheral wall 74 of the cylinder 71 is provided to be movable to open and close the second openings 68. That is, the peripheral wall 74 of the cylinder 71 is provided to be movable between the open position in which the second openings 68 are opened and the closed position in which the second openings 68 are closed. The side walls 72 of the cylinder 71 are provided fixedly to the peripheral wall 74 and are manipulated between the first position and the second position. The toner cartridge 6 is provided with the third manipulation members 82. The third manipulation members 82 are provided displaceable with respect to the cartridge case 51 and oppose the side walls 72 of the cylinder 71 from the outside with spaces formed therebetween.

The first position and the second position of the side walls 72 of the cylinder 71 respectively correspond to the open position and the closed position of the peripheral wall 74 of the cylinder 71. Thus, when the side walls 72 of the cylinder 71 are manipulated from the first position to the second position, the peripheral wall 74 of the cylinder 71 is moved from the open position to the closed position, whereby the second openings 68 are closed by the peripheral wall 74 of the cylinder 71. On the contrary, when the side walls 72 of the cylinder 71 are manipulated from the second position to the first position, the peripheral wall 74 of the cylinder 71 is moved from the closed position to the open position, whereby the second openings 68 are opened.

In the state in which the toner cartridge 6 is attached to the drum cartridge 5, the side walls 72 of the cylinder 71 and the third manipulation members 82 can be displaced in an integrated manner via the first manipulation members 44. In other words, in the state in which the toner cartridge 6 is not attached to the drum cartridge 5, the side walls 72 of the cylinder 71 and the third manipulation members 82 can be displaced independently. Accordingly, when the third manipulation members 82 are manipulated, the side walls 72 of the cylinder 71 are not manipulated (i.e., not moved) and the peripheral wall 74 of the cylinder 71 is not moved.

The third manipulation members 82 oppose the side walls 72 of the cylinder 71 from the outside with spaces formed therebetween. With this, undesirable contact of other members with the side walls 72 of the cylinder 71 can be prevented. Accordingly, undesirable opening of the second openings 68 formed in the cartridge case 51 can be prevented.

The first opening and closing member 49 is moved when the first manipulation members 44 are displaced integrally with the side walls 72 of the cylinder 71 and the third manipulation members 82 in the state in which the toner cartridge 6 is attached to the drum cartridge 5. Thus, both the first opening and closing member 49 and the peripheral wall 74 of the cylinder 71 can be moved with a single manipulation. Accordingly, manipulation performance for the movement of the first opening and closing member 49 and the peripheral wall 74 of the cylinder 71 is high.

(3) Operation and Effect 3

The second wall 67 has a circular arc cross section along a surface perpendicular to the width direction. The peripheral wall 74 of the cylinder 71 is provided to be movable in the circumferential direction of the second wall 67. Accordingly, the opening and closing member can be moved smoothly. In addition, a space necessary for the movement of the peripheral wall 74 of the cylinder 71 between the open position and the closed position can be reduced to the minimum.

(4) Operation and Effect 4

The side walls 72 of the cylinder 71 are formed in a disc shape. A central axis of each of the side walls 72 of the cylinder 71 is on a line extending in the width direction through the center of the circular arc cross section of the second wall 67. The side walls 72 of the cylinder 71 are provided to be rotatable about the line. As the side walls 72 of the cylinder 71 are rotated, the peripheral wall 74 of the cylinder 71 can be rotated integrally with the side walls 72, whereby the peripheral wall 74 of the cylinder 71 can be moved between the open position and the closed position.

(5) Operation and Effect 5

The third manipulation members 82 are formed in a disc shape. A central axis of each of the third manipulation members 82 is on a line passing through a rotation center of each of the side walls 72 of the cylinder 71. The third manipulation member 82 is provided to be rotatable about the line. Thus, when the side walls 72 of the cylinder 71 and the third manipulation members 82 are connected by the first manipulation members 44 in the state in which the toner cartridge 6 is attached to the drum cartridge 5, the side walls 72 of the cylinder 71 and the third manipulation members 82 can be rotated in an integrated manner. Accordingly, when the third manipulation members 82 are rotated, the side walls 72 of the cylinder 71 can be rotated, whereby the peripheral wall 74 of the cylinder 71 can be rotated integrally with the side walls 72 such that the peripheral wall 74 of the cylinder 71 is moved between the open position and the closed position.

(6) Operation and Effect 6

The ring-shaped ring portions 81 are formed in the cartridge case 51. The third manipulation members 82 are fit into and rotatably supported by the ring portions 81. Accordingly, the third manipulation members 82 can be supported by the cartridge case 51 in a stable manner with a simple structure.

(7) Operation and Effect 7

The input sections 84 to which driving force is input from the outside are formed in the third manipulation members 82. The third manipulation members 82 are rotated integrally with the manipulation members by the driving force input to the input sections 84. Thus, the peripheral wall 74 of the cylinder 71 can be moved between the open position and the closed position by the driving force.

(8) Operation and Effect 8

The side walls 72 of the cylinder 71 and the third manipulation members 82 are provided on both sides in the width direction with respect to the cartridge case 51. By the manipulation of both the manipulation members, the peripheral wall 74 of the cylinder 71 can be moved in a stable manner.

(9) Operation and Effect 9

The first manipulation members 44 are provided with the first engaging portions 45. The first portions to be engaged 73 are provided in the side walls 72 of the cylinder 71. When the toner cartridge 6 is attached to the drum cartridge 5, the first engaging portions 45 and the first portions to be engaged 73 engage each other. Thus, the first manipulation members 44 and the side walls 72 of the cylinder 71 are connected together and the first manipulation members 44 and the side walls 72 of the cylinder 71 can be displaced in an integrated manner.

(10) Operation and Effect 10

The first engaging portions 45 are formed as recessed grooves and the first portions to be engaged 73 are formed as protrusions. The first engaging portions 45 extend in the front-rear direction which is the attachment direction of the toner cartridge 6 to the drum cartridge 5 in a state in which the first openings 48 are closed by the first opening and closing member 49. The first portions to be engaged 73 extend in the attachment direction in a state in which the peripheral wall 74 of the cylinder 71 is in the closed position. Thus, when the toner cartridge 6 is moved to the attachment direction and is attached to the drum cartridge 5, the first engaging portions 45 and the first portions to be engaged 73 engage each other as the movement of the toner cartridge 6. Accordingly, the attachment of the toner cartridge 6 to the drum cartridge 5 and the engagement of the first engaging portions 45 with the first portions to be engaged 73 can be achieved with a single manipulation.

Since the first portions to be engaged 73 are moved along the first engaging portions 45 when the toner cartridge 6 is attached to the drum cartridge 5, the first engaging portions 45 and the first portions to be engaged 73 guide the movement of the toner cartridge 6 toward the drum cartridge 5. Accordingly, the toner cartridge 6 can be attached smoothly to the drum cartridge 5.

(11) Operation and Effect 11

The first manipulation members 44 are provided with the second engaging portions 46. The third manipulation members 82 are provided with the second portions to be engaged 83. When the toner cartridge 6 is attached to the drum cartridge 5, the second engaging portions 46 and the second portions to be engaged 83 engage each other. Thus, the first manipulation members 44 and the third manipulation members 82 are connected together and the first manipulation members 44 and the third manipulation members can be displaced in an integrated manner.

(12) Operation and Effect 12

The second engaging portions 46 are formed as protrusions and the second portions to be engaged 83 are formed as recessed grooves. The second engaging portions 46 extend in the attachment direction in a state in which the first openings 48 are closed by the first opening and closing member 49. The second portions to be engaged 83 extend in the front-rear direction in a state in which the peripheral wall 74 of the cylinder 71 is located in the closed position. Then, when the toner cartridge 6 is moved to the attachment direction and is attached to the drum cartridge 5, the second engaging portions 46 and the second portions to be engaged 83 engage each other as the movement of the toner cartridge 6. Accordingly, the attachment of the toner cartridge 6 to the drum cartridge 5 and engagement of the second engaging portions 46 with the second portions to be engaged 83 can be achieved with a single manipulation.

Since the second portions to be engaged 83 are moved along the second engaging portions 46 when the toner cartridge 6 is attached to the drum cartridge 5, the second engaging portions 46 and the second portions to be engaged 83 guide the movement of the toner cartridge 6 toward the drum cartridge 5. Accordingly, the toner cartridge 6 can be attached smoothly to the drum cartridge 5.

6. Modification

Although the first engaging portions 45 are formed as recessed grooves and the first portions to be engaged 73 are formed as protrusions, the first engaging portions 45 may alternatively be formed as protrusions and the first portions to be engaged 73 may be formed as recessed grooves.

Although the second engaging portions 46 are formed as protrusions and the second portions to be engaged 83 are formed as recessed grooves, the second engaging portions 46 may alternatively be formed as recessed grooves and the second portions to be engaged 83 may be formed as protrusions. The third manipulation members 82, which are protection members, may be formed in any shape capable of opposing the first portions to be engaged 73. That is, the third manipulation members 82 may be formed in any shape which is of the same size or larger than the first portions to be engaged 73 and covering the first portions to be engaged 73 when seen from a side view to protect the first portions to be engaged 73 from the contact with other members. For example, the third manipulation members 82 may be formed as blind or grids. The first portions to be engaged 73 may even be visible from the side as long as the third manipulation members 82 are formed in shapes to keep the first portions to be engaged 73 not to be readily accessible.

Various other design variations may be made in the range of the matters described in the claims.

What is claimed is:

1. A toner cartridge comprising:

a housing having a wall extending in a predetermined direction and configured to store toner;

an opening and closing member movable between an open position in which an opening formed in the wall is opened and a closed position in which the opening is closed;

a first operating member rotatable in conjunction with the opening and closing member and configured to rotate the opening and closing member between the open position and the closed position; and a second operating member configured to be rotatable and facing the first operating member with a space therebetween in an axial direction of the toner cartridge such that rotating of the second operating member is not directly transmitted to the first operating member, wherein the second operating member at least partially covers the first operating member.

2. The toner cartridge according to claim 1, wherein:

the wall has a circular arc cross section along a cutting surface perpendicular to the predetermined direction; and the opening and closing member is movable in a circumferential direction of the wall.

3. The toner cartridge according to claim 2, wherein the first operating member has a disc shape, a central axis of the first operating member is positioned on a line extending in the predetermined direction through a center of the circular arc cross section of the wall and the first operating member is rotatable about the line.

4. The toner cartridge according to claim 3, wherein the second operating member has a disc shape, a central axis of the second operating member is positioned on the line and the second operating member is rotatable about the line.

5. The toner cartridge according to claim 4, wherein the second operating member is fitted into the housing and a ring-shaped ring portion, which rotatably supports the second operating member, is formed in the housing.

6. The toner cartridge according to claim 4, wherein:

the second operating member comprises an input portion to which a driving force is input from an outside of the housing; and when the second operating member is rotated by the driving force input to the input portion, the first operating member is not rotated integrally with the second operating member.

7. The toner cartridge according to claim 1, wherein the first operating member and the second operating member are disposed at both sides, in the predetermined direction, of the housing.

8. A toner cartridge comprising:

a housing having a wall extending in a predetermined direction and configured to store toner;

an opening and closing member movable between an open position in which an opening formed in the wall is opened and a closed position in which the opening is closed;

a first operating member movable in conjunction with the opening and closing member and configured to move the opening and closing member between the open position and the closed position; and a second operating member configured to be movable and facing the first operating member with a space therebetween such that of the second operating member is not directly transmitted to the first operating member, wherein the second operating member comprises an input portion to which a driving force is input from an outside of the housing, and wherein the second operating member is displaceable and, when the second operating member is displaced by the driving force input to the input portion, the first operating member is not displaced integrally with the second operating member.

9. A process cartridge comprising:

a first cartridge; and a second cartridge configured to be attached to the first cartridge along an attachment direction, wherein the first cartridge comprises:

a frame having a first wall disposed along a width direction perpendicular to the attachment direction and configured to support a toner carrier which carries toner;

a first opening and closing member movable with respect to the first wall and configured to open and close a first opening formed in the first wall; and a first operating member movable in conjunction with the first opening and closing member and configured to be operated to open and close the first opening, wherein the second cartridge comprises:

a housing having a second wall adjacent to the first wall when the second cartridge is attached to the first cartridge and configured to store toner;

a second opening and closing member movable between an open position in which a second opening formed in the second wall is opened and a closed position in which the second opening is closed;

a second operating member movable in conjunction with the second opening and closing member and configured to move the second opening and closing member between the open position and the closed position; and a third operating member displaceable with respect to the housing and facing the second operating member with a space therebetween, and wherein, when the second cartridge is attached to the first cartridge, the second operating member and the third operating member are integrally displaced via the first operating member.

10. The process cartridge according to claim 9, wherein:

the first operating member comprises an engaging portion; and the second operating member comprises an engaged portion configured to engage the first engaging portion when the second cartridge is attached to the first cartridge.

11. The process cartridge according to claim 10, wherein:

one of the engaging portion and the first engaged portion is formed as a protrusion and the other is formed as a recessed groove;

the engaging portion extends in the attachment direction when the first opening is closed by the first opening and closing member; and the engaged portion extends in the attachment direction when the second opening and closing member is in the closed position.

12. The process cartridge according to claim 9, wherein:

the first operating member comprises an engaging portion; and the third operating member comprises an engaged portion configured to engage the engaging portion when the second cartridge is attached to the first cartridge.

13. The process cartridge according to claim 12, wherein:

one of the engaging portion and the engaged portion is formed as a protrusion and the other is formed as a recessed groove;

the engaging portion extends in the attachment direction when the first opening is closed by the first opening and closing member; and the engaged portion extends in the attachment direction when the second opening and closing member is located in the closed position.

14. The process cartridge according to claim 9, wherein:

the second wall has a circular arc cross section along a cutting surface perpendicular to the width direction; and the second opening and closing member is movable in a circumferential direction of the second wall.

15. The process cartridge according to claim 14, wherein the second operating member is formed in a disc shape, a central axis of the second operating member is on a line extending in the width direction through a center of the circular arc cross section of the second wall and the second operating member is rotatable about the line.

16. The process cartridge according to claim 15, wherein the third operating member is formed in a disc shape, a central axis of the third operating member is on the line and the third operating member is rotatable about the line.

17. The process cartridge according to claim 16, wherein the third operating member is fitted into the housing and a ring-shaped ring portion which rotatably supports the third operating member is formed in the housing.

18. The process cartridge according to claim 9, wherein an input portion to which driving force is input from an outside of the housing is formed in the third operating member.

* * * * *